US006128813A

United States Patent [19]

Rodriquez

[11] Patent Number: 6,128,813

[45] Date of Patent: Oct. 10, 2000

[54] TOOL FOR INSTALLING A BUSHING ON A HINGE OF A VEHICLE DOOR

[76] Inventor: Henry Robert Rodriquez, 623 Pickerll Ave., Corcoran, Calif. 93212

[21] Appl. No.: 09/129,604

[22] Filed: Aug. 5, 1998

[51] Int. Cl.[7] ..... B25B 27/14

[52] U.S. Cl. ..... 29/275

[58] Field of Search ..... 29/275, 277, 278, 29/280, 255, 270

[56] References Cited

U.S. PATENT DOCUMENTS

| | | | |
|---|---|---|---|
| D. 336,413 | 6/1993 | Ebert . | |
| 2,919,613 | 1/1960 | Crement . | |
| 3,064,342 | 11/1962 | Wagoner | 29/275 |
| 3,099,876 | 8/1963 | Lawless | 29/275 |
| 3,879,848 | 4/1975 | Murphy . | |
| 4,005,629 | 2/1977 | Franklin . | |
| 4,018,254 | 4/1977 | De Caro . | |
| 4,297,756 | 11/1981 | Lance . | |
| 5,012,567 | 5/1991 | Hill . | |
| 5,054,180 | 10/1991 | Combs . | |
| 5,201,105 | 4/1993 | Street . | |
| 5,218,749 | 6/1993 | Upthegrove | 29/275 |
| 5,438,743 | 8/1995 | Simington . | |

*Primary Examiner*—Robert C. Watson
*Attorney, Agent, or Firm*—Merek & Voorhees

[57] ABSTRACT

A hand tool for installing small parts such as door bushings in hard to reach areas. The hand tool includes a tool body having a handle section, a transition section and a head section. The head section includes first and second portions. The first and second portions are substantially cylindrical in shape. The diameter of the second portion is smaller than the first portion to readily receive and hold in place a small hollow part such as a bushing. The handle section, transition section and head section are oriented relative to each other to permit an individual to readily install a small part such as bushing in hard to reach areas on the first attempt. Preferably, the transition section and the handle section form an angle greater than 90°, while the transition section and the head section form an angle less than 90°. Preferably, the tool body is formed from steel.

10 Claims, 3 Drawing Sheets

2
C
D
E
4
6

2
A
6
5

6
A
2

D
2

D
6
4
5

TOOL FOR INSTALLING A BUSHING ON A HINGE OF A VEHICLE DOOR

FIELD OF THE INVENTION

The present invention is directed to the field of hand tools. More specifically, the present invention relates to hand tools to install small parts in hard to reach areas.

BACKGROUND OF THE INVENTION

The present invention stems from the lack of adequate tooling for installing small parts in hard to reach areas. More specifically, a real need exists for a hand tool which can install small parts such as bushings on the hinges of vehicle doors. This is especially true for bushings which are installed on door hinges of Chevrolet pick-up trucks. The angle of the door of the pick-up makes it very difficult for one individual to install a bushing on the door hinge without complete removal of the door. Removal of the door is undesirable because it is time consuming and often requires two individuals. Often mechanics are forced to search to find something to install the bushing on the door hinge of a pick-up truck. These make shift tools (i.e. tools designed for purposes other than installing a bushing such as a screw driver or other object) are simply inadequate for installing a small part such as a bushing on the hinge of a vehicle door. Often, the mechanic must make repeated attempts with the make shift tool in order to install the bushing or other small part in hard to reach areas.

A significant need, therefore, exists for a hand tool which can install small parts in hard to reach areas. This is especially true where the small part is a bushing to be installed on the door hinge of a pick-up truck.

OBJECTS AND SUMMARY OF THE INVENTION

An object of the present invention is to provide a novel and unobvious hand tool for installing small parts in hard to reach areas.

Another object of the present invention is to provide a hand tool for permitting an individual to readily install a door bushing on the hinge of a vehicle door.

A further object of the present invention is to provide a hand tool which permits an individual to install a bushing of a vehicle door without complete removal of the door.

Yet another object of the present invention is to provide a hand tool which can hold a door bushing in place while it is being installed on the hinge of a vehicle door.

Yet a further object of the present invention is to provide a hand tool for installing small parts in hard to reach areas which can be manufactured relatively inexpensively.

Still a further object of the present invention is to provide a hand tool for installing small parts in hard to reach areas which permits an individual to readily install the small part on the first attempt.

Yet still another object of the present invention is to provide a hand tool for installing small parts in hard to reach areas which is extremely durable.

These and other objects of the present invention will be readily apparent upon review of the following detailed description of the invention and the accompanying drawings. These objects are not exhaustive and are not to be construed as in any way limiting the scope of the claimed invention.

In summary, the present invention, in its preferred form, is directed to a hand tool for installing small parts such as door bushings in hard to reach areas. The hand tool includes a tool body having a handle section, a transition section and a head section. The head section includes first and second portions. The first and second portions are substantially cylindrical in shape. The diameter of the second portion is smaller than the first portion to readily receive and hold in place a small hollow part such as a bushing. The handle section, transition section and head section are oriented relative to each other to permit an individual to readily install a small part such as a bushing in hard to reach areas on the first attempt. Preferably, the transition section and the handle section form an angle greater than 90°, while the transition section and the head section form an angle less than 90°. Preferably, the tool body is formed from steel.

DETAILED DESCRIPTION OF THE PREFERRED EMBODIMENT OF THE PRESENT INVENTION

The preferred embodiment of the present invention will now be described with reference to FIGS. 1 to 7.

FIGS. 1 THROUGH 7

Figure 1:
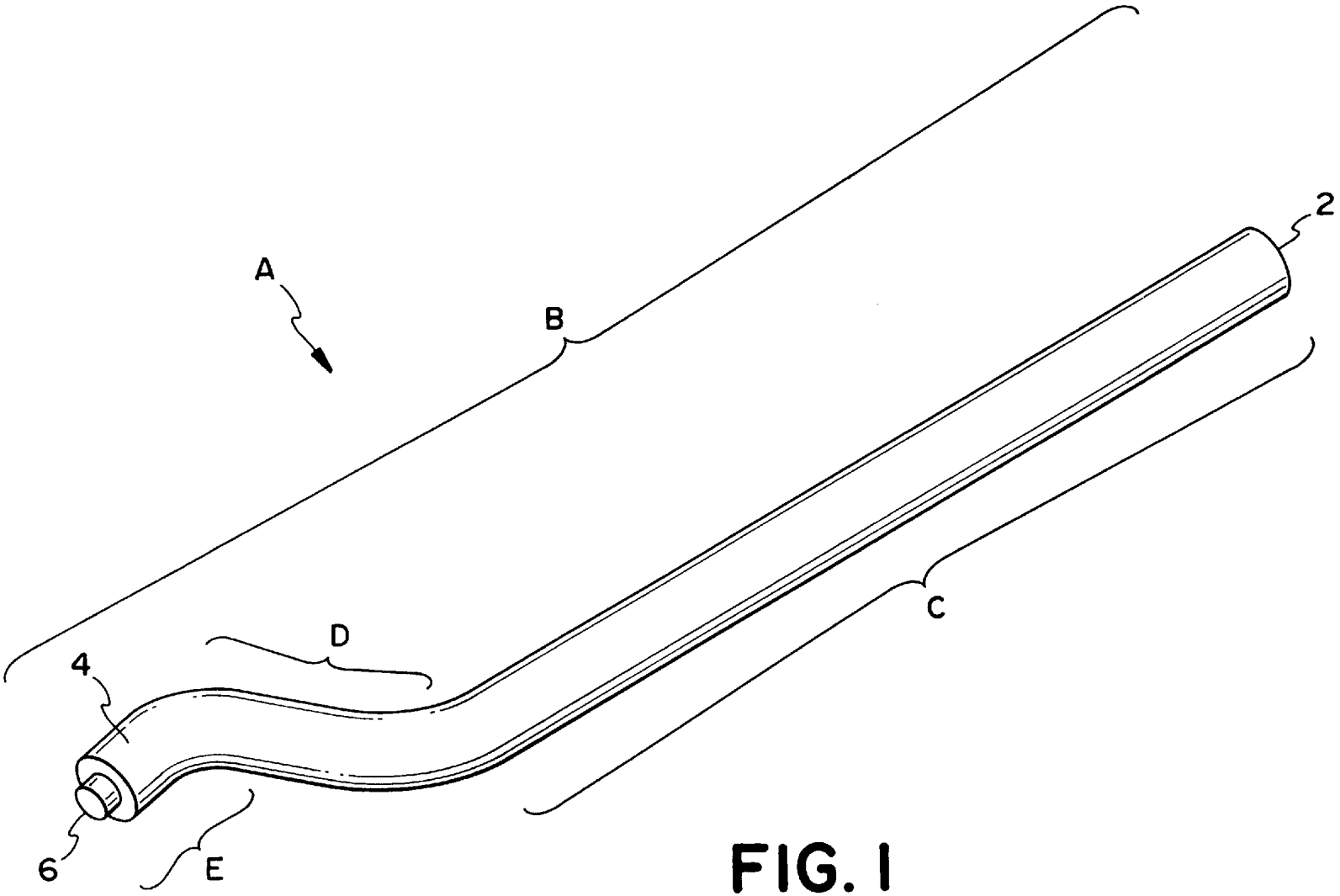
FIG. 1 is a perspective view of a preferred form of the present invention.
Figures 2, 3, 4, 5, 6:
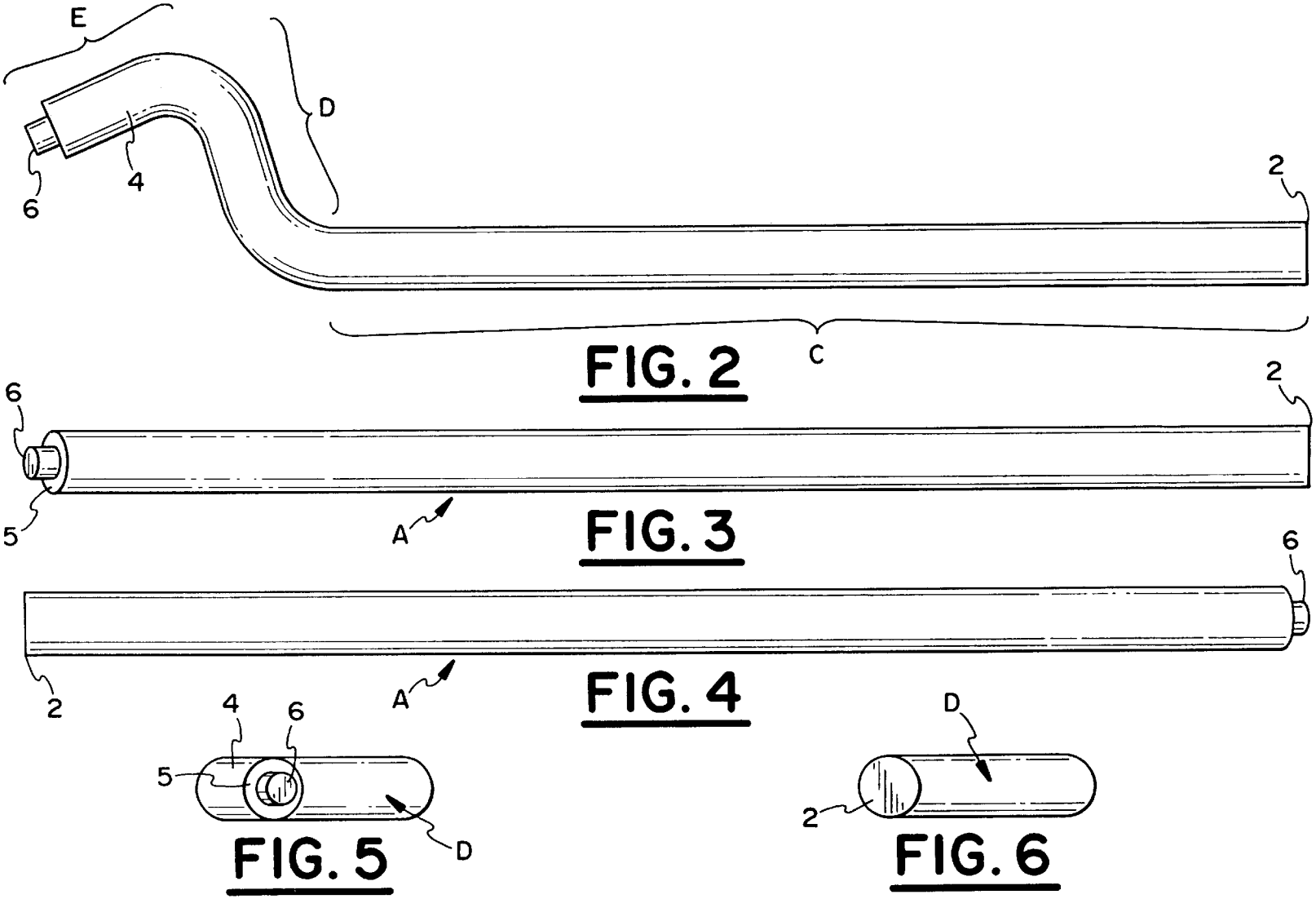
FIG. 2 is a side elevational view of the embodiment depicted in FIG. 1.
FIG. 3 is a bottom view of the embodiment depicted in FIG. 1.
FIG. 4 is a plan view of the embodiment depicted in FIG. 1.
FIG. 5 is a front view of the embodiment depicted in FIG. 1.
FIG. 6 is a rear view of the embodiment depicted in FIG. 1.

Referring to FIGS. 1 and 2, a hand tool A includes a tool body B having a handle section C, a transition section D and a head section E. Preferably, the tool body B is formed as a single piece from steel and is approximately 14 inches in length. However, it will be readily appreciated that other suitable materials and lengths may be used. The section C forms a major portion of the tool body B and has a uniform cross-section with a ⅝ of an inch diameter. Further, the handle section C is straight and is approximately ten inches in length. The right end 2 of the handle section C is substantially flat to provide a hammering surface, as seen in FIG. 6. Transition section D and said handle section C form an angle greater 90°. Transition section D has a uniform cross-section with a ⅝ of an inch diameter. The cross-section of the transition section D is the same size as the cross-section of the handle section C. Transition section D and head section E form an angle less than 90°.

Referring to FIGS. 1,2,3 and 5, the head section E is the forwardmost section of the tool body B and includes a first portion 4 and a second portion 6. The first portion 4 and second portion 6 are substantially cylindrical in shape. The diameter of the second portion 6 is smaller than the first portion 4 such that a bushing or other small hollow part may be readily placed on second portion 6. Specifically, the first portion 4 has a ⅝ of an inch diameter while second portion 6 has a ¼ of an inch diameter. The first portion has a length of approximately 1 and ¼ inches while the second portion 6 has a length of approximately ¼ of an inch. The cross-section of the first portion 4 is the same size as the cross-sections of the handle section C and the transition section D. The first portion 4 includes a force application surface 5. The force application surface 5 extends perpendicular to a longitudinal axis of the second portion 6.

Figure 7:
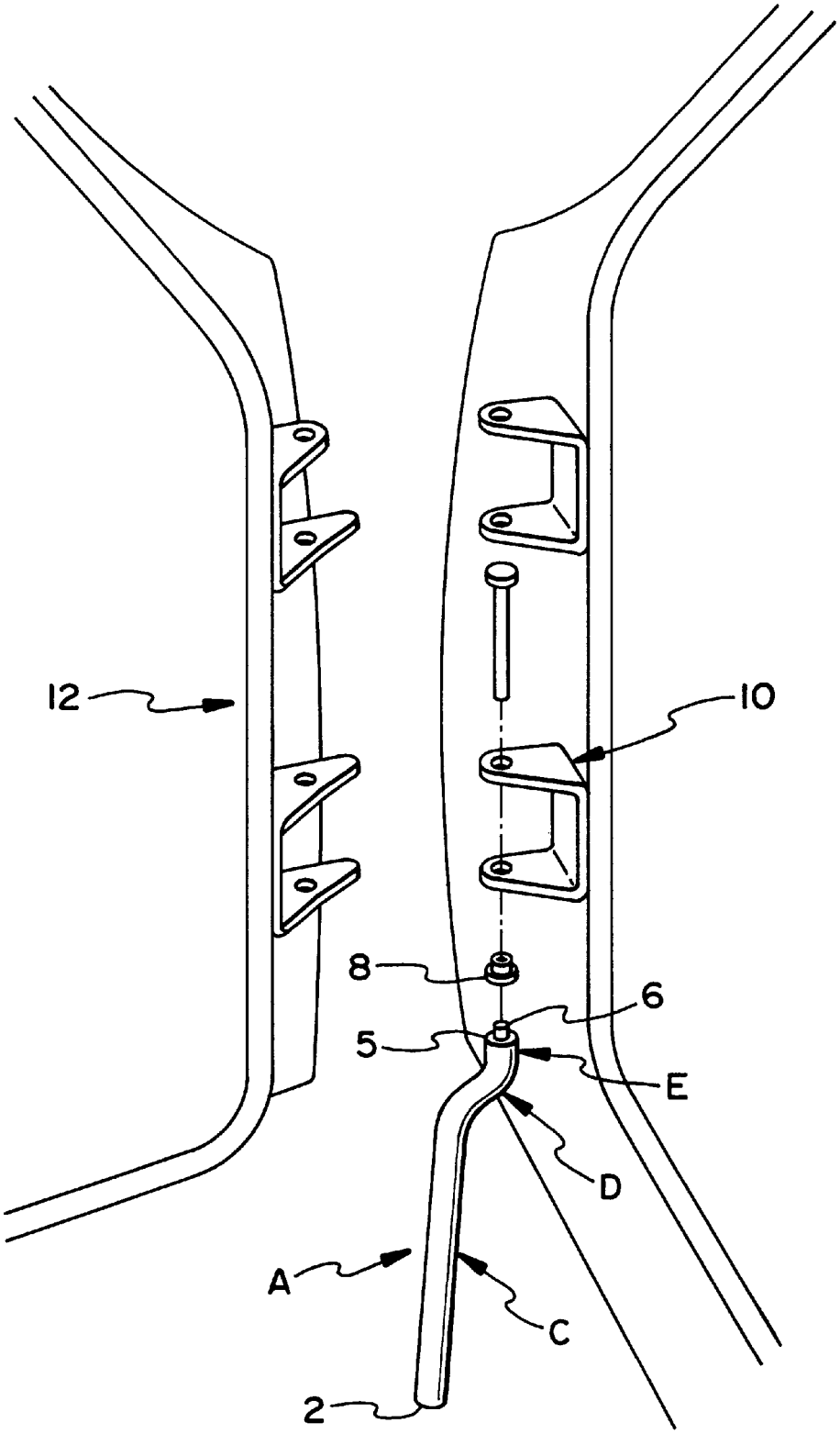
FIG. 7 is a perspective view of a vehicle door hinge in which the preferred embodiment is utilized to install a door bushing.

Referring to FIG. 7, the hand tool A readily permits an individual to install a door bushing 8 on the door hinge 10 of a vehicle door 12. To do so, an individual need merely place the bushing 8 on the second portion 6 of the head section E. The hand tool A is then aligned with an opening in the door hinge and a force is applied to the flat surface 2 of the handle section C which is transmitted to the bushing via the force application surface 5 to readily install the bushing on the door hinge. The orientation of the handle section C, transition section D and head section E is such that an individual can readily apply a striking or hammering force to flat surface 2 of handle section C to install the door bushing on the first attempt. The hand tool A also allows an individual to install the door bushing without complete removal of the vehicle door.

While this invention has been described as having a preferred design, it is understood that it is capable of further modifications, uses and/or adaptions of the invention following in general the principle of the invention and including such departures from the present invention as come within the known or customary practice in the art to which the invention pertains and as may be applied to the central features hereinbefore set forth, and fall within the scope of the invention and the limits of the appended claims.

I claim:

1. A hand tool for installing a bushing on a hinge of a vehicle door, comprising:

(a) a tool body having a handle section, a transition section and a head section, said transition section being positioned intermediate said handle section and said head section;

(b) said head section including first and second portions, said first portion being positioned adjacent said transition section and said second portion being removed from said transition section, said first portion having a force application surface for applying a force to a bushing to install the bushing on a hinge of a vehicle door, said second portion of said head section is substantially cylindrical in shape for receiving the bushing thereon prior to installation, (c) said first portion having an outermost perimeter;

(d) said second portion having an outermost perimeter; and, (e) said outermost perimeter of said second portion being positioned inwardly of said outermost perimeter of said first portion, (f) said transition section and said handle section extend linearly from a first angle section of greater than 90 degrees and said transition section and said head section extend linearly from a second angle section of less than 90 degrees.

2. A hand tool as set forth in claim 1, wherein:

a) said first portion of said head section is substantially cylindrical in shape.

3. A hand tool as set forth in claim 1, wherein:

a) said tool body is formed from steel.

4. A hand tool as set forth in claim 1, wherein:

a) said handle section includes a striking surface.

5. A hand tool as set forth in claim 1, wherein:

a) said first portion, said handle section and said transition section all have a cross-section of substantially the same size.

6. A hand tool, comprising:

(a) a tool body having a linear handle section, a linear transition section and a linear head section, said transition section being positioned intermediate said handle section and said head section;

(b) said head section including first and second portions, said first portion being positioned adjacent said transition section and said second portion being removed from said transition section, (c) said first portion having a substantially circular cross-section with a first diameter;

(d) said second portion having a substantially circular cross-section with a second diameter sized to receive a bushing thereon; and, (e) said first diameter being greater than said second diameter to form a force applying surface for applying a force to a bushing to install the bushing on the hinge of a vehicle door;

(f) said handle section having a striking surface;

(g) said handle section being of substantially longer length than said transition section and said transition section being of substantially longer length than said head section for spacing said striking surface vertically and horizontally away from said force applying surface.

7. A hand tool as set forth in claim 6, wherein:

a) said handle section and said transition section each having a substantially circular cross-section with a diameter equal to said first diameter of said first portion.

8. A hand tool as set forth in claim 6, wherein:

a) said tool body is formed from steel.

9. A hand tool as set forth in claim 6, wherein:

a) said handle section forms a major portion of said tool body.

10. A hand tool as set forth in claim 6, wherein:

a) said handle section is substantially straight.

* * * * *